US006460902B1

(12) United States Patent
Kyle

(10) Patent No.: US 6,460,902 B1
(45) Date of Patent: Oct. 8, 2002

(54) SLAM LATCH AND HATCH ASSEMBLY INCLUDING A SLAM LATCH

(75) Inventor: James H. Kyle, Keene, NH (US)

(73) Assignee: Pompanette, Inc., Charlestown, NH (US)

( * ) Notice: Subject to any disclaimer, the term of this patent is extended or adjusted under 35 U.S.C. 154(b) by 95 days.

(21) Appl. No.: 09/697,051

(22) Filed: Oct. 27, 2000

(51) Int. Cl.[7] ..... E05C 1/12

(52) U.S. Cl. ..... 292/165; 292/DIG. 31; 114/203

(58) Field of Search ..... 292/175, 165, 292/257, DIG. 31, 169, 140, 143, 173; 114/203

(56) References Cited

U.S. PATENT DOCUMENTS

| | | | | | |
|---|---|---|---|---|---|
| 885,866 | A | | 4/1908 | Roy | |
| 2,136,854 | A | | 11/1938 | Knott | |
| 2,141,659 | A | | 12/1938 | Nehls | |
| 2,207,569 | A | * | 7/1940 | Wild | 292/169 |
| 2,317,700 | A | * | 4/1943 | Thompson | 292/254 |
| 2,321,724 | A | | 6/1943 | Aldeen et al. | |
| 2,415,587 | A | * | 2/1947 | Groeger | 292/173 |
| 2,722,445 | A | | 11/1955 | Cudney | |
| 2,772,809 | A | | 12/1956 | Ross | |
| D180,260 | S | | 5/1957 | Adams et al. | |
| D210,153 | S | | 2/1968 | Pastva, Jr. | |
| 3,389,932 | A | | 6/1968 | Pastav, Jr. | |
| 3,751,949 | A | * | 8/1973 | Castle | 70/144 |
| 4,309,884 | A | * | 1/1982 | Davis | 70/472 |
| 4,693,503 | A | | 9/1987 | Bisbing | |
| 4,928,615 | A | * | 5/1990 | Williams | 114/203 |
| D316,365 | S | | 4/1991 | Hansen et al. | |
| D324,636 | S | | 3/1992 | Schlack et al. | |
| 5,201,557 | A | | 4/1993 | Schlack | |
| 5,234,238 | A | * | 8/1993 | Takimoto | 292/216 |
| 5,267,762 | A | | 12/1993 | Gromotka | |
| 5,351,639 | A | * | 10/1994 | Ortelli | 114/203 |
| 5,409,272 | A | * | 4/1995 | McCormack | 292/66 |
| 5,460,419 | A | * | 10/1995 | Castoldi | 292/336.3 |
| 5,609,373 | A | | 3/1997 | Gromotka | |
| 6,109,669 | A | * | 8/2000 | Pinkow | 292/175 |
| 6,152,501 | A | * | 11/2000 | Magi et al. | 292/336.3 |

OTHER PUBLICATIONS

Southco, Inc., Form No. Ml80294 (Catalog).
Southco, Inc., Form No. Mll095 (Catalog).

* cited by examiner

*Primary Examiner*—Anthony Knight
*Assistant Examiner*—John B. Walsh
(74) *Attorney, Agent, or Firm*—Dennison, Schultz & Dougherty

(57) ABSTRACT

A hatch assembly for a marine vessel included a slam latch and a frame and a cover having the slam latch disposed therein. The slam latch includes a housing having inner and outer portions and a pivotal handle for rotation between open and closed positions. A reciprocal fastening element including a second cam surface is adapted to engage the frame for retaining the cover against the frame. A spring biases the handle into a closed position and together with the first cam surface maintains the handle in an opened position when the handle is rotated through a predetermined angle. The latch also includes a push rod for converting the rotation of the handle to the reciprocal movement of the fastening element. The latch also includes a pair of seals to prevent water from passing through the latch.

12 Claims, 4 Drawing Sheets

SLAM LATCH AND HATCH ASSEMBLY INCLUDING A SLAM LATCH

FIELD OF THE INVENTION

This invention relates to an improved slam latch and more particularly to a slam latch with an improved seal construction for a marine hatch assembly. The invention also relates to a marine hatch assembly including a slam latch with an improved seal.

BACKGROUND FOR THE INVENTION

The marine industry has for some time utilized slam action latches and hatch assemblies which include such latches. Such latches typically incorporate a spring to bias a latch bolt into a latch position against a keeper or a frame member. Rotary handles are provided such as a pull ring so that the latch bolt may be moved away from the keeper in opposition to the spring and into an unlatched position. Such latches have also been available in a number of designs ranging from a very simple flush latch and pull ring to more complex devices which incorporate a key lock and/or a trigger release mechanism.

The problem with many such latches is that water, a particularly important consideration in the marine industry, and even dirt often pass through the latch and into the interior of the vessel. Other problems associated with the prior art devices include complexity, cost, durability, difficulty with installation and cost of installation, appearance, size, etc.

It is presently believed that there may be a relatively large commercial market for an improved slam latch and hatch assembly in accordance with the present invention. There should be a large demand for such latches and hatches in view of an improved double seal which minimizes the likelihood of water passing through the latch even under the worst conditions. Furthermore, the latches in accordance with the present invention can be manufactured at a competitive price, easily and inexpensively installed in a hatch without hardware, incorporate a flush handle design. The latches are also relatively compact in size, durable and offer a pleasing appearance.

BRIEF SUMMARY OF THE INVENTION

The present invention contemplates a slam latch for mounting in an aperture of a vessel and a hatch cover for releasably retaining the cover against a corresponding frame. The latch comprises a housing having inner and outer portions and a pivotal handle. The handle is pivotally attached to the housing by a pivot pin and is rotatable between open and closed positions. The latch also includes a reciprocal fastening means or element. The fastening means or element includes a cam surface and is adapted to engage the frame for retaining the cover against the frame when the handle is in a closed position. The latch also includes biasing means such as a spring for biasing a handle in a closed position and for maintaining the handle in an opened position. The latch also includes a push rod which is biased by the spring for engaging the cam surface on the reciprocal fastening means to thereby convert or transmit the rotational movement of the handle to reciprocal movement of the fastening means. The latch also includes a first seal between the push rod and the inner portion of the housing and a second seal between an outer portion of the housing and a hatch cover. This double seal prevents water from passing through the latch.

A second embodiment of the invention relates to a hatch assembly for a marine vessel. The hatch assembly or hatch includes a frame which defines an opening and which is adapted to fit into an aperture in the wall of a vessel. The hatch also includes a cover which is rotatably mounted on or to the frame for opening and closing the hatch. The cover includes a first recessed portion and a second recessed portion within the first recessed portion. The second recessed portion includes an inner and outer surface and defines an opening which extends from the first recess portion through the cover. A slam latch for the hatch assembly comprising a housing having a first portion including an outer surface and a recessed inner surface and a second portion formed integrally with the first portion. This housing of the slam latch has inner and outer surfaces. The housing is disposed in the first recessed portion of the cover with the second portion of the housing extending through the opening which is defined by the second recessed portion of the cover. A pivot is disposed in the first portion of the housing and a handle is mounted on the pivot for rotation between an opened and a closed position.

The slam latch also includes reciprocal fastening means such as a striker element which includes a cam surface and a striker portion for engaging the frame and for maintaining the cover in a closed position. A spring and a push rod biased by the spring forces the push rod into contact with the cam surface to covert the rotational movement of the handle into reciprocal movement of the striker element. In a preferred embodiment of the invention a second spring is incorporated to bias the striker element outwardly into a closed position. In addition a first seal such as an O-ring seal is provided between the push rod and the inner surface of the second portion of the housing. A second seal is also provided between the outer surface of the second portion of the housing and the second recessed portion of the cover to prevent water from passing through the latch.

The invention will now be described in connection with the accompanying drawings wherein like reference numerals have been used to designate like parts.

DETAILED DESCRIPTION OF THE PREFERRED EMBODIMENTS OF THE INVENTION

Figure 1:
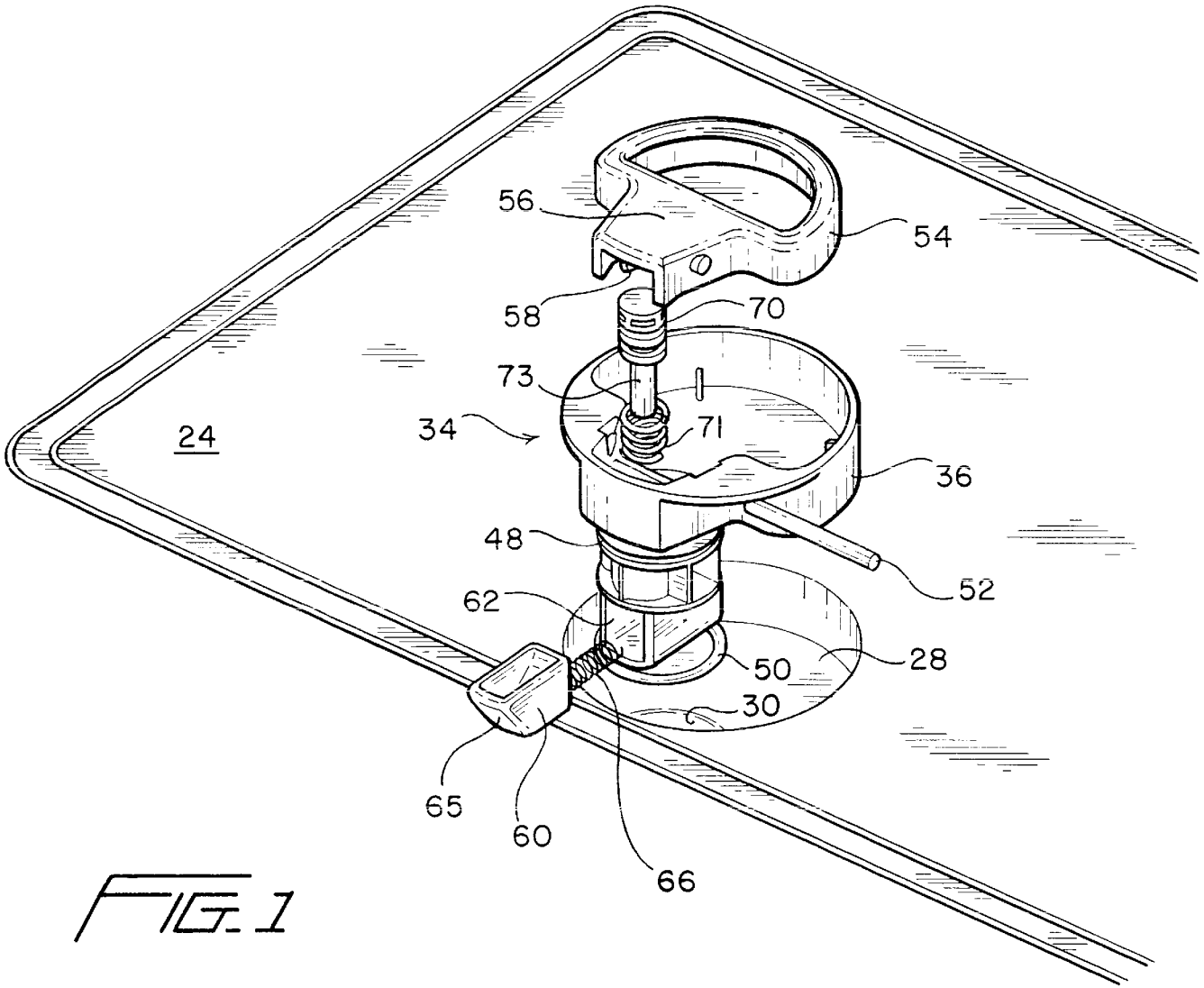
FIG. 1 is an exploded perspective view of a hatch cover including a slam latch in accordance with the present invention.
Figure 2:
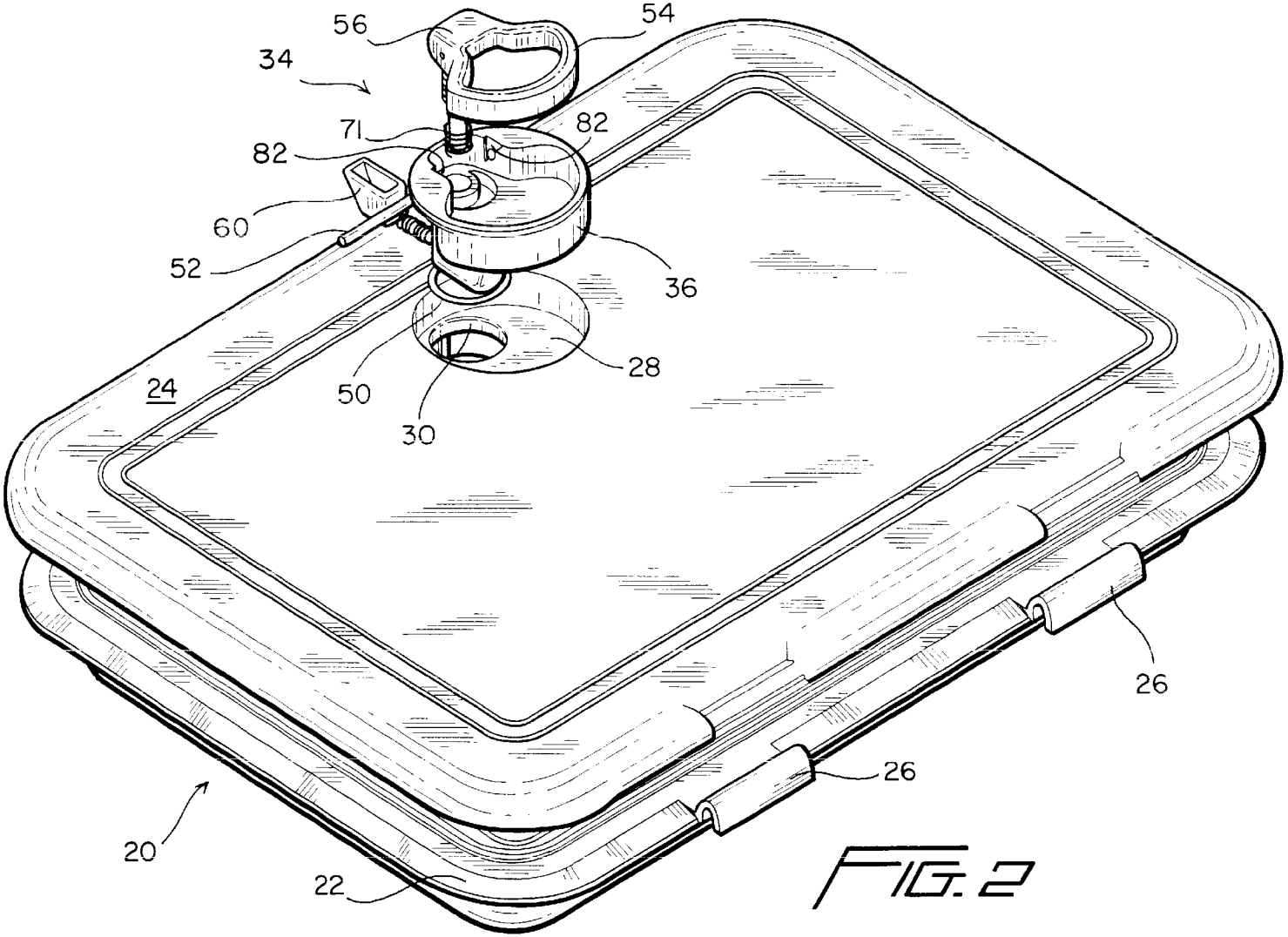
FIG. 2 is an exploded perspective view of a hatch assembly in accordance with one embodiment of the present invention.
Figure 3:
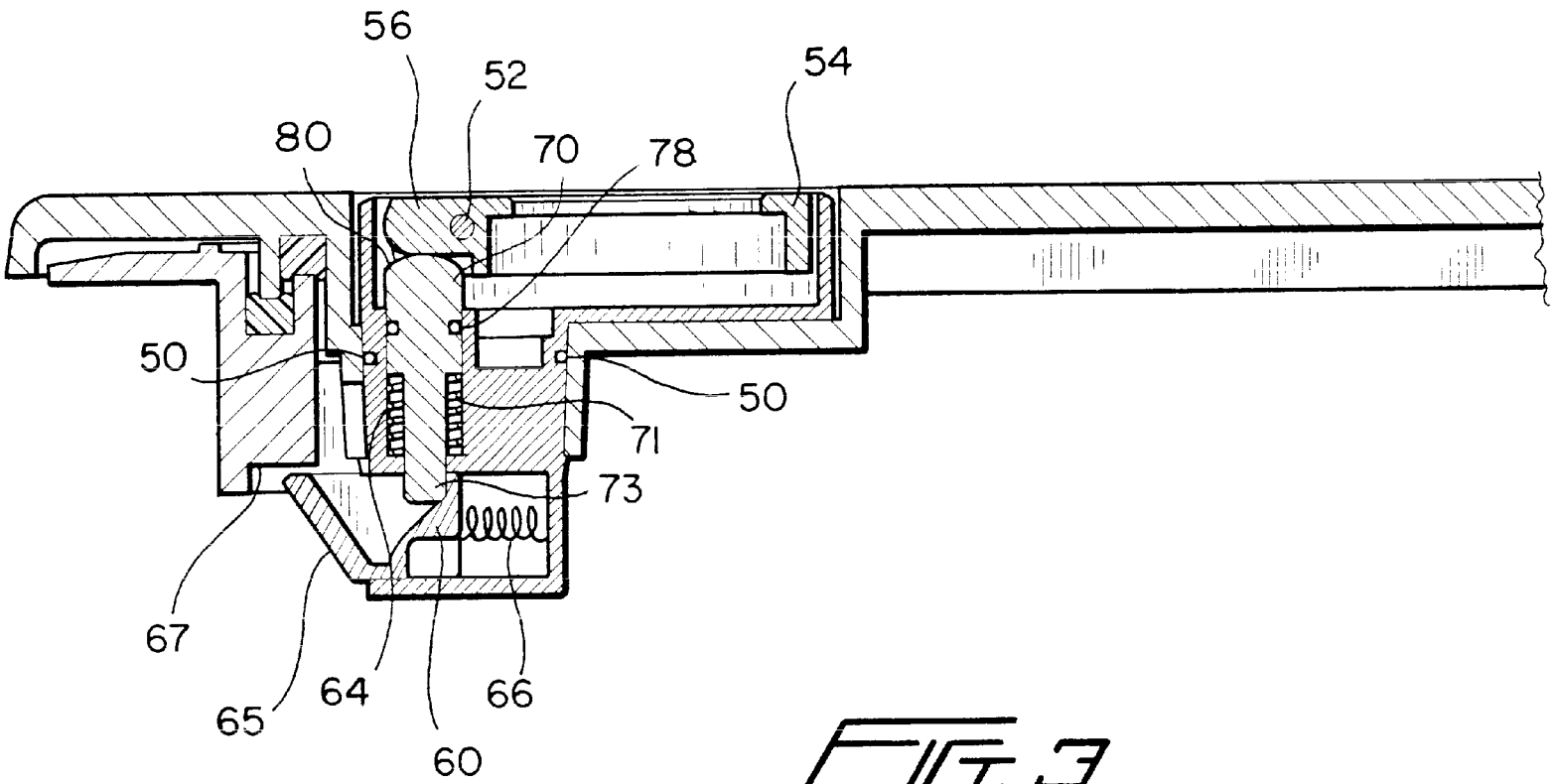
FIG. 3 is a cross-sectional view of a hatch assembly including a slam latch as illustrated in FIGS. 1 and 2.

A slam action latch and marine hatch assembly in accordance with the present invention are illustrated in FIGS. 1–3. As shown therein, a hatch assembly 20 for a marine vessel or the like includes a generally rectangular frame 22 (see FIG. 2). This frame 22 or outer frame defines an opening and is constructed and arranged to fit into an aperture in a vessel in a conventional manner. The hatch assembly 20 also includes a hatch cover or cover 24 which is rotatably mounted on the frame 22 by a pair of hinges 26 as shown in FIG. 2.

As shown in FIGS. 1–3 the hatch cover 24 includes a generally circular recessed portion 28 which is adapted to receive a latch therein as will be described hereinafter. The hatch cover 24 also includes a second recessed portion 30 having an inner surface which defines a passageway that extends from the bottom of the recessed portion 28 through the cover 24.

A slam action latch 34 preferably has a generally circular shape and is constructed and arranged to fit in the recessed portion 28.

Figure 4:
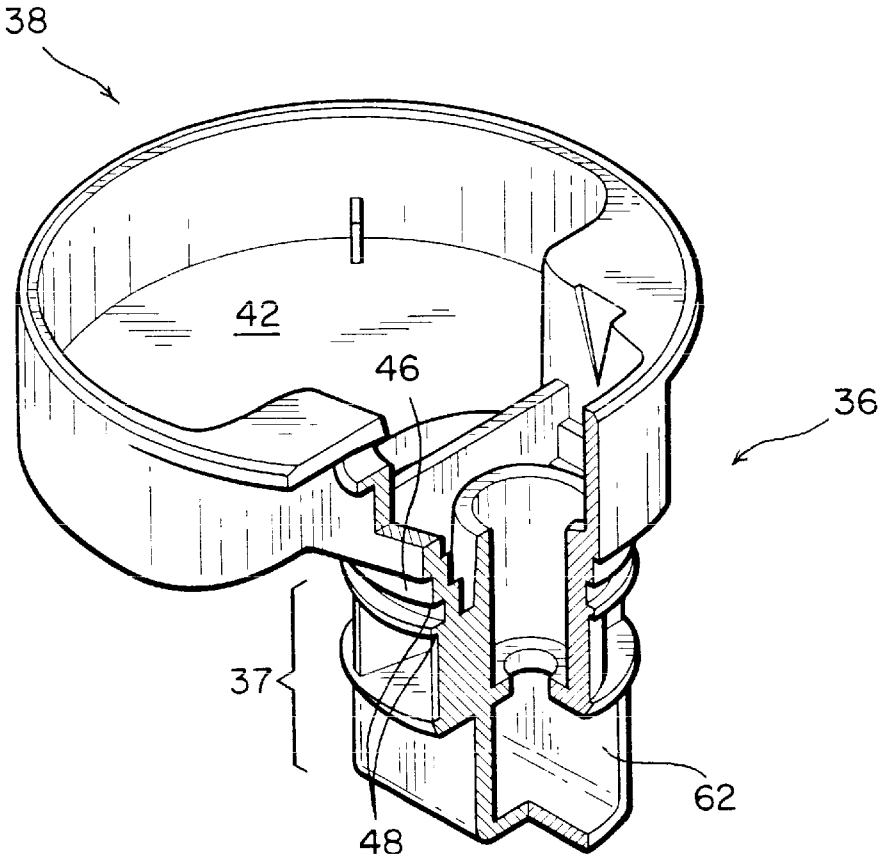
FIG. 4 is a perspective view partially broken away of a latch housing as incorporated in a slam latch in accordance with a preferred embodiment of the invention.

The slam latch 34 includes a housing 36. The housing 36 in a preferred embodiment of the invention is illustrated in more detail in FIG. 4. This housing 36 includes a first or upper portion 38 which includes an outer surface 40 and a recessed inner surface 42 which is constructed and arranged to receive a flush fitting handle (not shown in FIG. 4) therein. The housing 36 also includes a lower portion 37 which is formed integrally with the upper portion 38. The lower portion 37 extends downwardly from the upper portion 38 and includes inner and outer surfaces 44 and 46 respectively.

In the preferred embodiment of the invention the housing is formed of a calcium filled polypropylene. The key components other than one or more springs and a metal pivot are also formed or molded from the same material.

The first or upper portion 38 (see FIG. 4) of the housing 36 is sized to fit within the recess portion 28 of the hatch cover 24. The sizing of the upper portion 38 and recessed portion 28 are such that the housing 36 will slide easily into the recess portion 28 with a minimal amount of space between their respective walls. In a preferred embodiment of the invention the first or upper portion 38 of the housing 36 is then adhesively bonded to the recess surface 42. Any conventional adhesive which is compatible with the materials used may be used.

The lower portion 37 of the housing 36 extends downwardly through the second recessed portion 30 of the cover 24 and defines a groove 48 (see FIG. 4) for receiving an O-ring seal 50 (FIGS. 1 and 3). This O-ring seal 50 forms a first tight seal between the outer surface 46 and an inner surface of the second recessed portion 30 of the cover 24.

Figure 5:
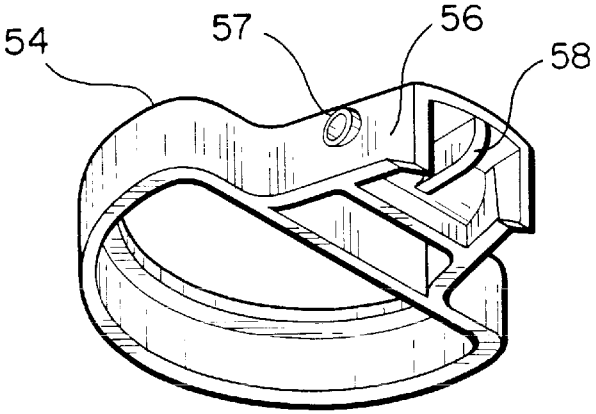
FIG. 5 is a perspective view of a latch handle as incorporated in a slam latch in accordance with a preferred embodiment of the invention.

A pivot 52 (FIGS. 1 and 2) passes through the upper portion 38 of the housing 36. A rotatable preferably D-shaped handle 54 is rotatably mounted on a pivot 50. This generally D-shaped handle 54 includes a general trapezoidal extension 56 which extends rearwardly from the back of the D (see FIG. 5).

The extension 56 of the handle 54 also includes an opening 57 passing through the extension 56 which may be in the form of a longitudinally extending passageway for mounting the handle 54 on the pivot 50. This extension 56 also includes a cam or cam surface 58 which extends rearwardly away from the D-shaped portion of the handle and rearwardly of the opening 57 and pivot 50.

Figure 6B:
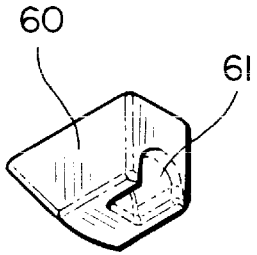
FIGS. 6*a* and 6*b* are perspective views of a striker element as incorporated in a slam latch in accordance with a preferred embodiment of the invention.
Figure 6A:
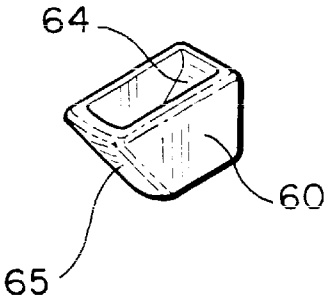

A reciprocal fastening means or striker element 60 is disposed in a generally rectangular shaped passageway 62 in the lower portion 37 of the housing 36. This striker element 60 shown in more detail in FIGS. 6A and 6B includes a cam surface 64 and an inclined surface or striker 65 which is adapted to engage a side of the frame 22. When the striker 65 strikes the frame as when the cover is slammed shut, the element 60 is forced back into the passageway 62 which allows the cover to be fully closed and then held in position by the striker element 60 as it is biased into a fully extended or closed position.

A first biasing means such as a spring 66 is disposed in the passageway 62 and engages a recessed portion 61 in the element 60. The spring 66 forces the striker element outwardly when the striker surface 65 passes beyond a wall of the frame or striker plate to engage a recess 67 (FIG. 3) to lock the cover 24 in a closed position.

The slam latch 34 also includes a push rod 70 which is biased in a first direction by a coil spring 71. The push rod 70 includes a lower portion 73 of reduced diameter and an upper portion 75 which forms a shoulder between the upper and lower portions. The coil spring 71 fits over the lower portion 73 and rest against the shoulder formed by the upper portion 75 and a seat 76 (see FIG. 2) in the lower portion 37 of the housing 36. That seat 76 is disposed above the rectangular passageway 62.

The lower portion 73 of the push rod contacts the cam surface 64 (FIG. 3). Then when the handle 54 is rotated upwardly it converts the rotational movement of the handle to reciprocal movement of the striker element 60 by forcing the striker element rearwardly into the passageway 62 which allows the cover 24 to open.

An important feature of the present invention resides in the use of a second seal within the latch assembly. For example in a preferred embodiment of the invention, a second O-ring seal 78 (FIG. 3) is disposed in a groove which runs around the upper portion of the push rod 70. This O-ring seal 78 is in sealing engagement with an inner surface of the second recess portion. It is the combination of the seal 50 and seal 78 which prevents water from passing through the latch.

The preferred embodiment of the invention also includes means for maintaining the handle 54 in an opened position with the striker element 60 in a retracted position within the passageway 62. In this case, the push rod 70 includes a domed top surface 80 which contacts the cam surface 58. Then when the handle is rotated to a predetermined angle of for example 90 degrees or slightly beyond 90 degrees, the domed surface 80 of the push rod forces the handle against a pair of shoulders 82 (FIG. 2) until sufficient force is used to push the handle towards its closed position. The push rod 70 then forces the handle into its closed and recessed position.

While the invention has been described in connection with its preferred embodiments, it should be recognized that changes and modifications may be made therein without departing from the scope of the appended claims.

What is claimed is:

1. A slam action latch for mounting in an aperture of a hatch cover for releasably retaining the cover against a corresponding frame, said latch comprising a housing having inner and outer portions and a pivotal handle pivotally attached to said housing and being rotatable between an opened and a closed position, reciprocal fastening means including a cam surface, said reciprocal fastening means engaging the frame for retaining the cover against the frame when the handle is rotated to a closed position, biasing means for biasing said handle in a closed position and means for retaining said handle in an open position, said latch assembly including a push rod for engaging said cam surface to thereby transmit rotational movement of said handle to reciprocal movement of said fastening means, a first seal between said push rod and said inner portion of said housing and a second seal between said outer portion of said housing and a hatch cover whereby the two seals prevent water from passing through the slam action latch.

2. A slam latch according to claim 1 in which said handle is recessed in said inner portion of said housing.

3. A slam latch according to claim 2 in which said biasing means is a coil spring.

4. A slam latch according to claim 3 in which said push rod includes a first portion of a first diameter and a second portion of a reduced diameter to thereby form a shoulder between said first and second portions of said push rod and wherein said coil spring is disposed against said shoulder and has an outside diameter about equal to the diameter of said first portion of said push rod.

5. A slam latch according to claim 3 which includes a second spring for biasing said fastening means outwardly into a closed position.

6. A slam latch according to claim 1 in which each of said seals is an O-ring seal.

7. A slam latch assembly for mounting in an aperture in a marine hatch cover for releasable retaining the cover against a corresponding frame, said slam latch assembly comprising a housing having a first portion including an outer surface and a recessed inner surface and a second portion formed integrally with said first portion and having an outer surface, said first portion defining a first passageway and a second passageway connecting said first passageway and said recessed inner surface of said first portion, and a pivotal handle pivotally attached to said housing and disposed within said recessed inner surface, said handle being rotatable between an open and a closed position, and reciprocal fastening means including a cam surface and an inclined striker element disposed in said first passageway with said striker element extending outwardly therefrom for engaging a corresponding frame member to retain a cover against the frame when said handle is in a closed position, and means for retaining said handle in an open position, said hatch assembly including a spring and a spring biased push rod for contacting said cam surface to thereby convert the rotational movement of said handle to reciprocal movement of said fastening means, a first seal between said push rod and said second passageway and a second seal between said outer surface of said second portion of said housing and a hatch cover whereby the two seals prevent water from passing through the slam action latch.

8. A slam latch assembly according to claim 7 in which said second passageway is cylindrical and in which said push rod has a cylindrical shape and is in sliding contact with said second passageway.

9. A slam latch assembly according to claim 8 in which said first passageway is perpendicular to said second passageway.

10. A slam action latch assembly according to claim 9 in which said pivotal handle includes a pivot and said push rod is disposed off center with respect to said pivot and wherein said cam surface and said spring biased push rod maintains said handle in an open position after it is rotated by a predetermined amount.

11. A hatch for a marine vessel including a frame defining an opening for fitting within an aperture within a vessel and a hatch cover rotatably mounted on said frame for opening and closing said hatch, said cover including a first recessed portion and a second recessed portion within said first recessed portion, said recessed portion including an inner surface and defining an opening extending through said cover, and a slam latch including a housing having a first portion including an outer surface and a recessed inner surface and a second portion formed integrally with said first portion and having inner and outer surfaces, said first portion of said housing disposed in said first recessed portion of said cover with said second portion of said housing extending through said opening defined by said second recessed portion, a pivot disposed in said first portion of said housing and a handle pivotally attached to said housing by said pivot and being rotatable between an open and a closed position, reciprocal fastening means including a cam surface, said reciprocal fastening means engaging said frame for retaining the cover when the handle is rotated to a closed position, a spring for biasing said handle in a closed position and means including said spring for retaining said handle in an open position, said slam latch including a push rod for contacting said cam surface to thereby convert rotational movement of said handle to reciprocal movement of said fastening means, a first seal between said push rod and said inner surface of said second portion of said housing and a second seal between said outer surface of said second portion of said housing and said second recessed portion of said cover whereby water is prevented from passing through said latch assembly.

12. A hatch assembly according to claim 11 in which said frame includes a groove and a rib extending around said frame and said cover includes a rib and a groove extending around said cover and said rib of said cover mating with said groove of said frame and said rib in said frame mating with said groove and said cover when said cover is in a closed position and which includes a seal in each of said grooves for sealingly engagement with said ribs.

* * * * *